US010550866B2

(12) United States Patent
Sakaue et al.

(10) Patent No.: US 10,550,866 B2
(45) Date of Patent: Feb. 4, 2020

(54) UNDERWATER ACTUATOR AND UNDERWATER VEHICLE INCLUDING THE SAME

(71) Applicant: KAWASAKI JUKOGYO KABUSHIKI KAISHA, Kobe-shi, Hyogo (JP)

(72) Inventors: Hiroshi Sakaue, Kobe (JP); Minehiko Mukaida, Kobe (JP); Noriyuki Okaya, Kobe (JP); Takashi Okada, Kobe (JP); Fumitaka Tachinami, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 30 days.

(21) Appl. No.: 15/759,351

(22) PCT Filed: Sep. 6, 2016

(86) PCT No.: PCT/JP2016/004059
§ 371 (c)(1),
(2) Date: Mar. 12, 2018

(87) PCT Pub. No.: WO2017/043069
PCT Pub. Date: Mar. 16, 2017

(65) Prior Publication Data

US 2018/0252245 A1 Sep. 6, 2018

(30) Foreign Application Priority Data

Sep. 10, 2015 (JP) ..... 2015-178687

(51) Int. Cl.
*F15B 15/20* (2006.01)
*B63C 11/00* (2006.01)
(Continued)

(52) U.S. Cl.
CPC ..... *F15B 15/202* (2013.01); *B63C 11/00* (2013.01); *F15B 15/226* (2013.01); *F15B 15/149* (2013.01)

(58) Field of Classification Search
CPC ..... E21B 23/04; E21B 41/04; E21B 33/0355; B63C 11/00; F15B 15/226; F15B 15/202
See application file for complete search history.

(56) References Cited

FOREIGN PATENT DOCUMENTS

EP 2 487 103 A1 8/2012
JP 2011-063159 A 3/2011
(Continued)

*Primary Examiner* — Abiy Teka
(74) *Attorney, Agent, or Firm* — Oliff PLC

(57) ABSTRACT

An underwater actuator includes: a housing to be immersed under water; a cylinder chamber formed in the housing; a piston accommodated in the cylinder chamber so the piston is movable in a sliding manner in the cylinder chamber, the piston dividing the cylinder chamber into a first and a second pressure receiving chambers; a rod extending from the piston to the first pressure receiving chamber side, the rod penetrating the housing; a release chamber formed in the housing, having an internal pressure kept lower than a water pressure outside of the housing; and a switching mechanism including: a first switcher configured to switch a communication state between the second pressure receiving chamber and the outside of the housing to allow or block communication therebetween; and a second switcher configured to switch a communication state between the second pressure receiving chamber and the release chamber to allow or block communication therebetween.

9 Claims, 5 Drawing Sheets

(51) Int. Cl.
*F15B 15/22* (2006.01)
*F15B 15/14* (2006.01)

(56) References Cited

FOREIGN PATENT DOCUMENTS

| | | | | | |
|---|---|---|---|---|---|
| WO | 98/20257 | A1 | | 5/1998 | |
| WO | WO-9820257 | A1 | * | 5/1998 | ..... E21B 33/035 |

* cited by examiner

UNDERWATER ACTUATOR AND UNDERWATER VEHICLE INCLUDING THE SAME

TECHNICAL FIELD

The present invention relates to an underwater actuator used under water and an underwater vehicle including the same.

BACKGROUND ART

At seabed resource development sites, underwater actuators for performing various work under seawater are used. For example, Patent Literature 1 discloses an underwater separator. In Patent Literature 1, in order to collect an underwater measurement device moored to a weight after underwater observation has been done, the underwater separator causes the underwater measurement device to release a rope connected to the weight, thereby separating the underwater measurement device from the weight. The underwater separator is configured to drive a motor to move a hook-fixing pin to a releasing position. As a result, a hook that is holding the rope is released from a fixed state, and the hook rotates downward about a support pin due to its own weight.

CITATION LIST

Patent Literature

PTL 1: Japanese Laid-Open Patent Application Publication No. 2011-63159

SUMMARY OF INVENTION

Technical Problem

However, the underwater separator disclosed in Patent Literature 1 is configured to cause the hook to rotate by utilizing the hook's own weight. Therefore, once the hook has rotated, the hook cannot be brought back to its position before the rotation. For this reason, such an underwater actuator utilizing its own weight cannot be used for work that requires bi-directional driving.

In view of the above, an object of the present invention is to provide an underwater actuator capable of bi-directional driving and an underwater vehicle including the underwater actuator.

Solution to Problem

In order to solve the above-described problems, an underwater actuator according to the present invention includes: a housing to be immersed under water; a cylinder chamber formed in the housing; a piston accommodated in the cylinder chamber such that the piston is movable in a sliding manner in the cylinder chamber, the piston dividing the cylinder chamber into a first pressure receiving chamber and a second pressure receiving chamber; a rod extending from the piston to the first pressure receiving chamber side, the rod penetrating the housing; a release chamber formed in the housing, the release chamber having an internal pressure kept lower than a water pressure of outside of the housing; and a switching mechanism including: a first switcher configured to switch a communication state between the second pressure receiving chamber and the outside of the housing to allow or block communication therebetween; and a second switcher configured to switch a communication state between the second pressure receiving chamber and the release chamber to allow or block communication therebetween.

According to the above-described configuration, when the underwater actuator is under water, by bringing the second pressure receiving chamber into communication with the outside of the housing by means of the first switcher, the piston can be moved to the first pressure receiving chamber side by the water pressure led to the second pressure receiving chamber, and thereby the rod can be expanded from the housing. On the other hand, by bringing the second pressure receiving chamber into communication with the release chamber by means of the second switcher, the piston can be moved to the second pressure receiving chamber side by the water pressure exerted on the distal end of the rod, and thereby the rod can be retreated into the housing. As thus described, by switching the communication states, i.e., allowing or blocking the communication, between the second pressure receiving chamber and the outside of the housing and between the second pressure receiving chamber and the release chamber, the rod can be driven bi-directionally.

In the above underwater actuator, a first passage, through which water is led from the outside of the housing to the second pressure receiving chamber, and a second passage, through which water is released from the second pressure receiving chamber to the release chamber, may be formed in the housing. The first switcher may be provided on the first passage, and the second switcher may be provided on the second passage.

In the above underwater actuator, the first passage and the second passage may include a shared passage that is shared at the second pressure receiving chamber side. According to this configuration, by forming the shared passage, the internal configuration of the housing can be simplified.

In the above underwater actuator, the shared passage may be provided with a restricting mechanism. According to this configuration, the moving speed of the rod can be regulated by restricting the flow velocity of water flowing into the second pressure receiving chamber or flowing out of the second pressure receiving chamber by the restricting mechanism.

In the above underwater actuator, a sliding chamber connected to the second pressure receiving chamber via the shared passage may be formed in the housing, and the switching mechanism may be a single spool configured to move in a sliding manner in the sliding chamber. According to this configuration, the switching of the communication states, i.e., allowing or blocking the communication, between the second pressure receiving chamber and the outside of the housing and between the second pressure receiving chamber and the release chamber can be performed by moving the single spool in the sliding chamber in a sliding manner. This makes it possible to realize a simple configuration of the switching mechanism with fewer components.

In the above underwater actuator, the spool may move in the sliding chamber from one end toward another end thereof, such that a position of the spool shifts from a first position to a second position and a third position in this order. When the spool is in the first position, the first switcher may block the second pressure receiving chamber from the outside of the housing, and the second switcher may block the second pressure receiving chamber from the release chamber. When the spool moves from the first position to the second position, the first switcher may allow the second pressure receiving chamber to communicate with the outside of the housing, and the second switcher may keep blocking the second pressure receiving chamber from the release chamber. When the spool moves from the second position to the third position, the first switcher may block the second pressure receiving chamber from the outside of the housing, and the second switcher may allow the second pressure receiving chamber to communicate with the release chamber. According to this configuration, bi-directional driving of the rod can be realized with the configuration that moves the spool in a single direction.

In the above underwater actuator, the switching mechanism may further include a third switcher configured to switch a communication state between the release chamber and the outside of the housing to allow or block communication therebetween. According to this configuration, by causing the underwater actuator to rise after the release chamber has been brought into communication with the outside of the housing by the third switcher, the internal pressure of the release chamber can be reduced in accordance with decrease in the water pressure of the outside of the housing. As a result, on the ocean, the underwater actuator can be collected in a condition where the pressure in the release chamber is reduced.

In the above underwater actuator, the switching mechanism may further include a third switcher configured to switch a communication state between the release chamber and the outside of the housing to allow or block communication therebetween. The spool may move in the sliding chamber from one end toward another end thereof, such that a position of the spool shifts from a first position to a second position, a third position, and a fourth position in this order. When the spool is in the first position, the first switcher may block the second pressure receiving chamber from the outside of the housing, the second switcher may block the second pressure receiving chamber from the release chamber, and the third switcher may block the release chamber from the outside of the housing. When the spool moves from the first position to the second position, the first switcher may allow the second pressure receiving chamber to communicate with the outside of the housing, the second switcher may keep blocking the second pressure receiving chamber from the release chamber, and the third switcher may keep blocking the release chamber from the outside of the housing. When the spool moves from the second position to the third position, the first switcher may block the second pressure receiving chamber from the outside of the housing, the second switcher may allow the second pressure receiving chamber to communicate with the release chamber, and the third switcher may keep blocking the release chamber from the outside of the housing. When the spool moves from the third position to the fourth position, the first switcher may keep blocking the second pressure receiving chamber from the outside of the housing, the second switcher may block the second pressure receiving chamber from the release chamber, and the third switcher may allow the release chamber to communicate with the outside of the housing. According to this configuration, bi-directional driving of the rod and safe collection of the underwater actuator can be realized with the configuration that moves the spool in a single direction.

In the above underwater actuator, a compressible fluid may be encapsulated in the first pressure receiving chamber. The cylinder chamber may include: a movement region, in which the piston moves between a rod-expanded position and a rod-retreated position, the movement region forming the second pressure receiving chamber and a part of the first pressure receiving chamber; and an auxiliary region, into which the compressible fluid of the movement region flows when the piston moves from the rod-retreated position to the rod-expanded position, the auxiliary region forming a remaining part of the first pressure receiving chamber. A pressure in the auxiliary region may be lower than the water pressure of the outside of the housing when the piston moves from the rod-retreated position to the rod-expanded position. This configuration makes it possible to move the piston from the rod-retreated position to the rod-expanded position assuredly.

In the above underwater actuator, the piston may move between a rod-expanded position and a rod-retreated position, and cushioning that contacts with the piston when the piston is in the rod-expanded position and/or cushioning that contacts with the piston when the piston is in the rod-retreated position may be provided in the cylinder chamber. According to this configuration, an impact shock when the moving piston stops in the rod-expanded position and/or an impact shock when the moving piston stops in the rod-retreated position can be absorbed by the cushioning.

An underwater vehicle according to one aspect of the present invention includes: the above-described underwater actuator, in which the switching mechanism is the single spool; and a drive device configured to move the spool in a sliding manner. This configuration makes it possible to simplify the configuration of the underwater actuator.

An underwater vehicle according to another aspect of the present invention includes: the above-described underwater actuator, in which the spool moves in the sliding chamber such that the position of the spool shifts from the first position to the second position and the third position; and an electric actuator including a drive shaft configured to push the spool. The spool and the drive shaft are not coupled together. According to this configuration, since the spool and the drive shaft are not coupled together, the underwater actuator can be readily removed from the underwater vehicle.

Advantageous Effects of Invention

The present invention makes it possible to provide an underwater actuator capable of bi-directional driving and an underwater vehicle including the underwater actuator.

DESCRIPTION OF EMBODIMENTS

Figure 1:
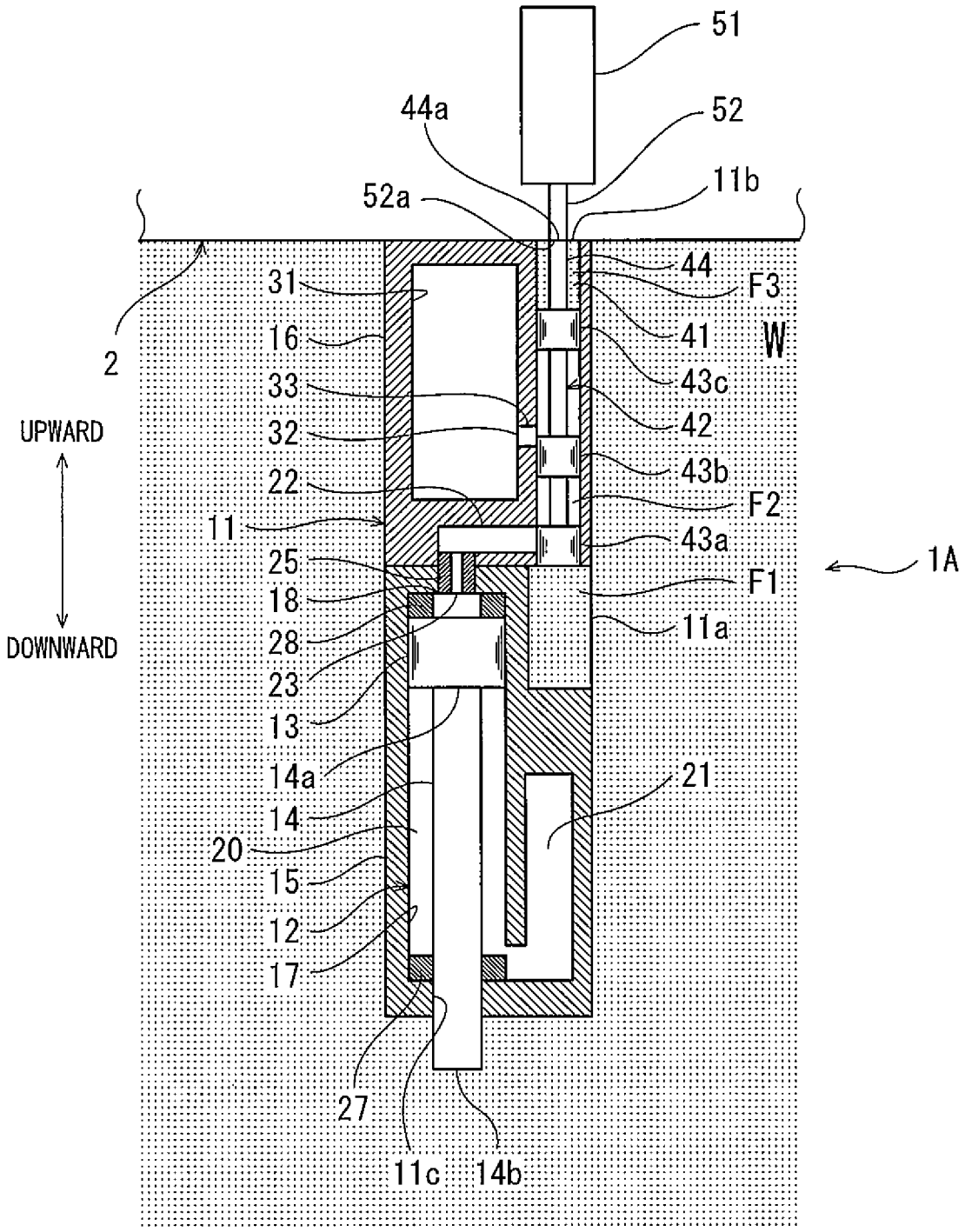
FIG. 1 shows a schematic configuration of an underwater actuator according to one embodiment of the present invention.
Figure 2:
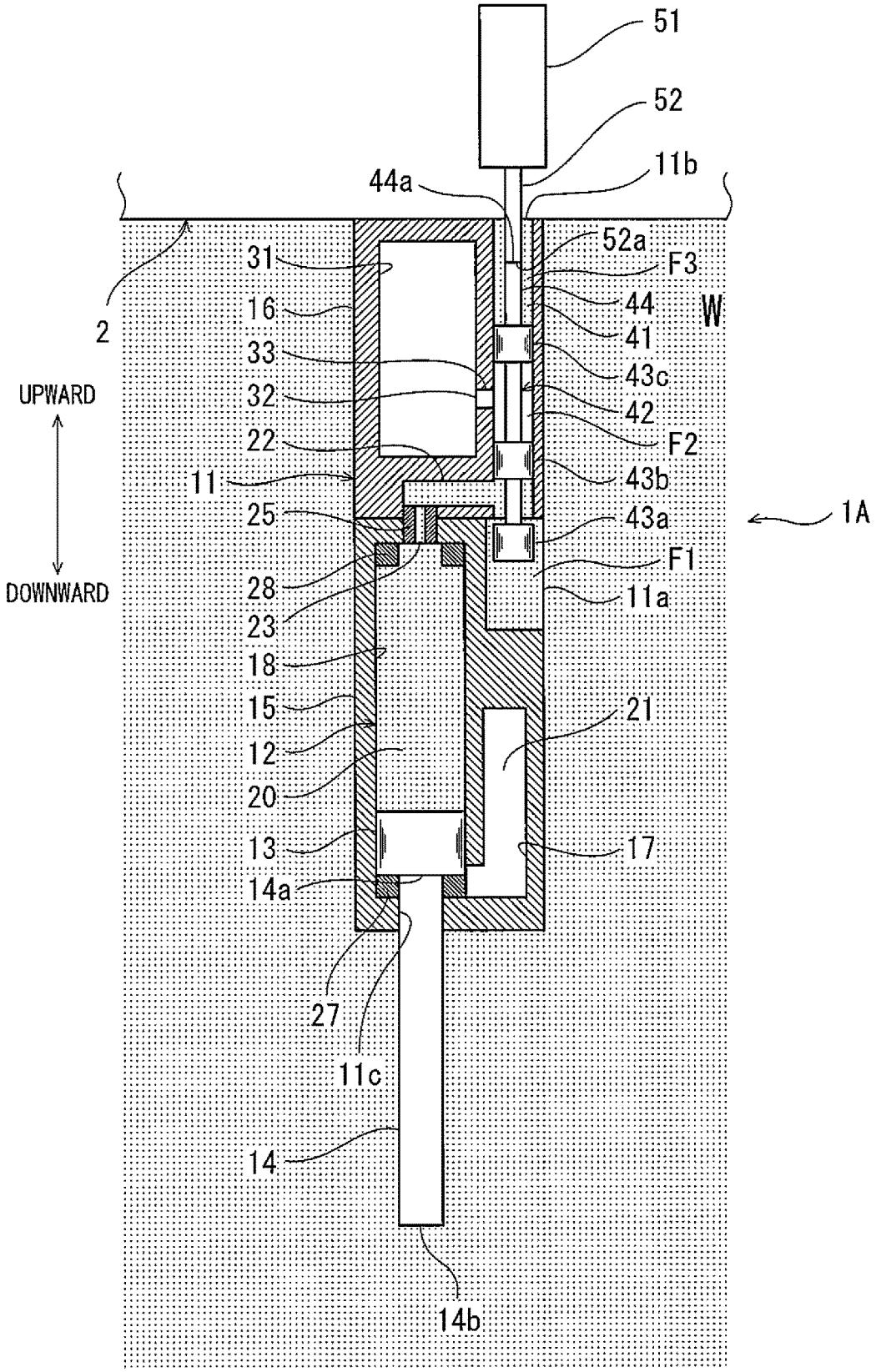
FIG. 2 shows state where a second pressure receiving chamber of the underwater actuator of FIG. 1 communicates with the outside of a housing.
Figure 3:
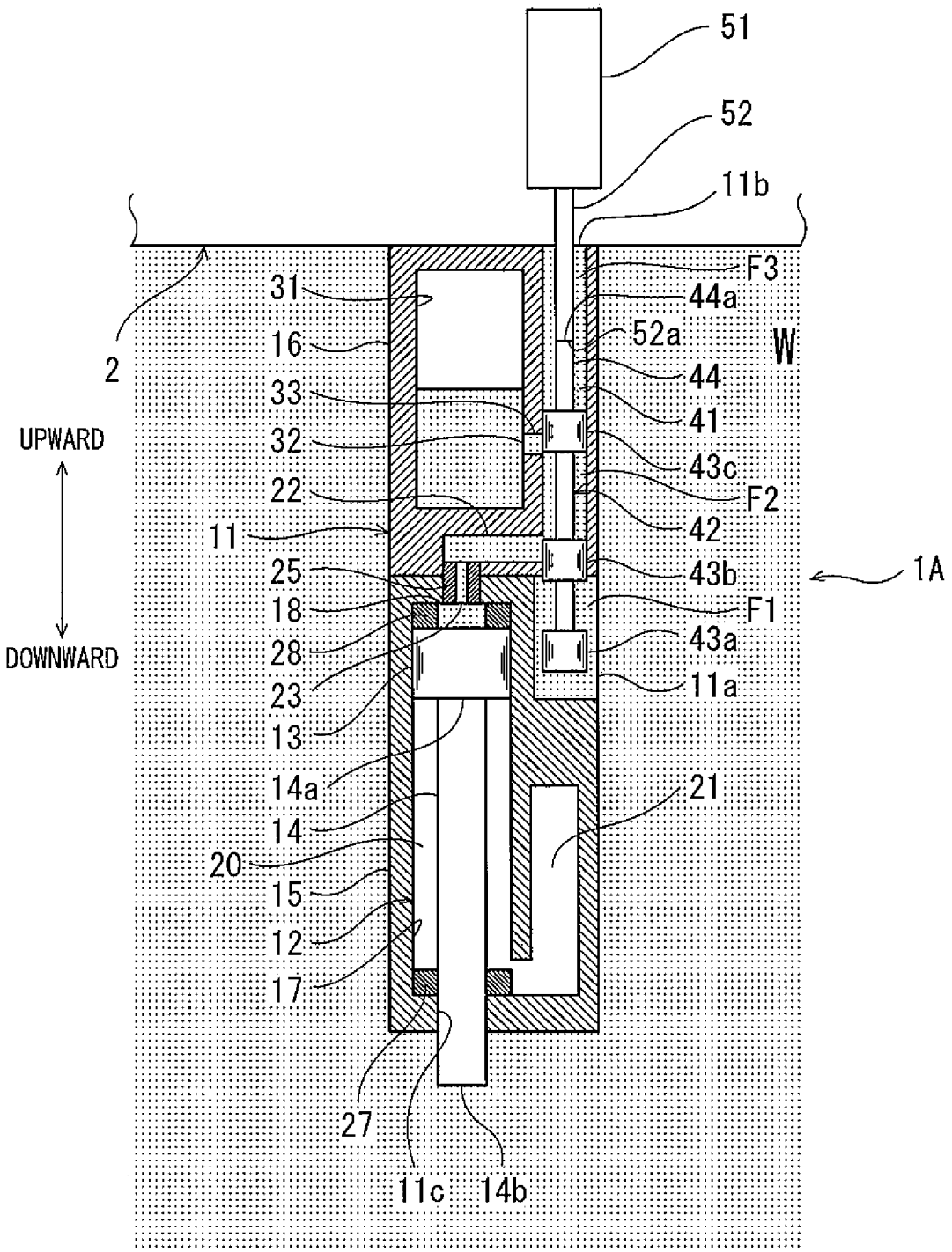
FIG. 3 shows a state where the second pressure receiving chamber of the underwater actuator of FIG. 1 communicates with a release chamber.
Figure 4:
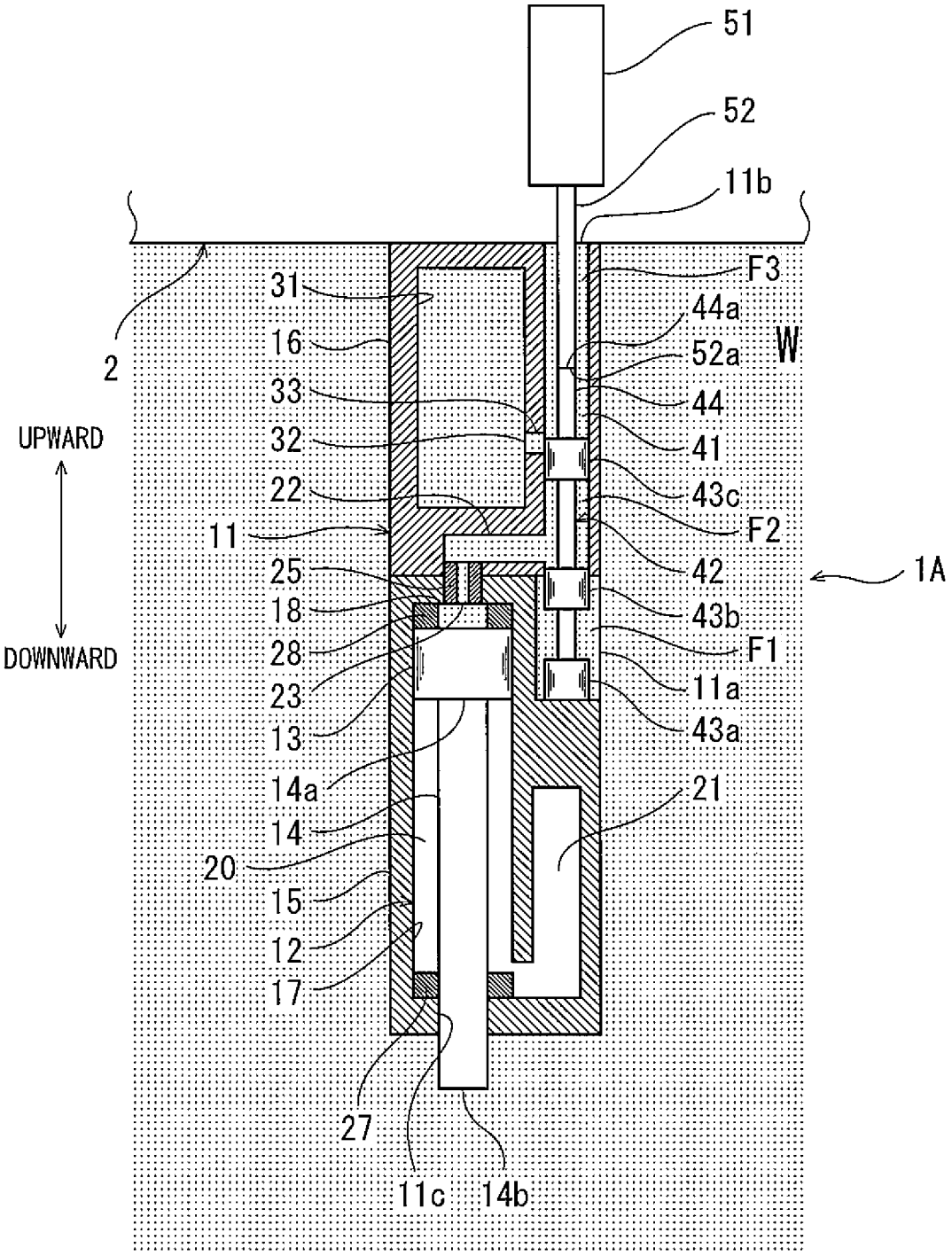
FIG. 4 shows a state where the release chamber of the underwater actuator of FIG. 1 communicates with the outside of the housing.

Hereinafter, one embodiment of the present invention is described with reference to the drawings. FIG. 1 is a diagram for describing a schematic configuration of an underwater actuator 1A according to the embodiment of the present invention. FIG. 2 to FIG. 4 are diagrams for describing switching operations performed by a switching mechanism (described below) included in the underwater actuator 1A. FIG. 1 to FIG. 4 show the underwater actuator 1A mounted to the lower part of an underwater vehicle 2. In the description below, it is assumed that the underwater vehicle 2 has submerged under water (e.g., under seawater) to a position where the underwater actuator 1A is to be driven. Also in the description below, for the sake of convenience of the description, the upward direction and the downward direction in FIG. 1 are defined as the "upward direction" and the "downward direction", respectively.

As shown in FIG. 1, the underwater actuator 1A is removably attached to the lower part of the underwater vehicle 2. The underwater vehicle 2 is, for example, a remotely operated unmanned underwater vehicle (ROV; Remotely Operated Vehicle) that is connected by a cable to a mother ship on the ocean. The underwater vehicle 2 is, for example, an autonomous unmanned underwater vehicle (AUV; Autonomous Underwater Vehicle). Alternatively, the underwater vehicle 2 may be a manned vehicle. The underwater vehicle 2 is mounted with unshown devices such as a drive device, a measurement device, and a monitoring device that are intended for, for example, seabed work or seabed research.

The underwater actuator 1A according to the present embodiment includes: a housing 11 to be immersed under water; and a cylinder chamber 12 formed in the housing 11. The housing 11 further includes: a piston 13 accommodated in the cylinder chamber 12 such that the piston 13 is movable in a sliding manner in the cylinder chamber 12 in the up-down direction; and a rod 14 connected to the piston 13.

The housing 11 has pressure tightness. The housing 11 has a substantially rectangular parallelepiped shape and is long in the up-down direction. A first opening 11*a* is formed in one of the side surfaces of the housing 11, and a second opening 11*b* is formed in the upper surface of the housing 11. Through the first opening 11*a* and the second opening 11*b*, water flows into the housing 11 from the outside W, or water or gas present in the housing 11 flows out of the housing 11 to the outside W. It should be noted that, in the present embodiment, the inside of the underwater vehicle 2 and the outside W of the housing 11 communicate with each other, and the water from the outside W of the housing 11 flows through the inside of the underwater vehicle 2, and passes through the second opening 11*b*.

The housing 11 is configured to be dividable into a first casing 15, in which the cylinder chamber 12 is formed, and a second casing 16, in which a release chamber 31 described below is formed.

The cylinder chamber 12 is segmented by the piston 13 into lower and upper chambers that are a first pressure receiving chamber 17 and a second pressure receiving chamber 18. The rod 14 linearly extends from the piston 13 to the first pressure receiving chamber 17 side, and penetrates the housing 11 through a through-hole 11*c* formed in the lower part of the housing 11. The rod 14 includes a proximal end portion 14*a*. The proximal end portion 14*a* is, in the cylinder chamber 12, connected to a surface of the piston 13 on the first pressure receiving chamber 17 side. The rod 14 further includes a rod distal end portion 14*b*. The rod distal end portion 14*b* is an end portion positioned on the opposite side to the proximal end portion 14*a*, and is disposed on the outside W of the housing 11. For example, a manipulator mechanism, a jack mechanism, or a sampler device is connected to the rod distal end portion 14*b* via a linking device (these mechanisms and devices are not shown). A sealing material (not shown) for supporting the rod 14 in a slidable manner and sealing up the first pressure receiving chamber 17 is provided around the through-hole 11*c*. The first pressure receiving chamber 17 forms a sealed space that is isolated from any other spaces.

The rod 14 expands outward from the housing 11 when the piston 13 moves to the first pressure receiving chamber 17 side, and the rod 14 retreats inward into the housing 11 when the piston 13 moves to the second pressure receiving chamber 18 side. The cylinder chamber 12 is formed such that the piston 13 is movable within a range from a rod-retreated position (see FIG. 1) where the rod 14 is retreated to a rod-expanded position (see FIG. 2) where the rod 14 is expanded.

Cushioning 27 is provided in the first pressure receiving chamber 17 of the cylinder chamber 12, such that the cushioning 27 contacts with the piston 13 when the piston 13 is in the rod-expanded position. Similarly, cushioning 28 is provided in the second pressure receiving chamber 18 of the cylinder chamber 12, such that the cushioning 28 contacts with the piston 13 when the piston 13 is in the rod-retreated position. The cushioning 27 absorbs an impact shock when the piston 13 moves from the rod-retreated position and stops in the rod-expanded position, and the cushioning 28 absorbs an impact shock when the piston 13 moves from the rod-expanded position and stops in the rod-retreated position.

In an initial state of the underwater actuator 1A before the rod 14 is driven, the piston 13 is disposed such that it is in the rod-retreated position. When the underwater actuator 1A is in the initial state, a compressible fluid is encapsulated in each of the first pressure receiving chamber 17 and the second pressure receiving chamber 18. The compressible fluid is, for example, air. Also, when the underwater actuator 1A is in the initial state, the internal pressure of each of the first pressure receiving chamber 17 and the second pressure receiving chamber 18 is, for example, kept to the atmospheric pressure.

The cylinder chamber 12 includes: a movement region 20, in which the piston 13 moves between the rod-expanded position and the rod-retreated position; and an auxiliary region 21, into which the compressible fluid of the movement region 20 flows when the piston 13 moves from the rod-retreated position to the rod-expanded position. The movement region 20 forms the second pressure receiving chamber 18 and a part of the first pressure receiving chamber 17. The auxiliary region 21 forms the remaining part of the first pressure receiving chamber 17. The auxiliary region 21 has a sufficient volume for keeping a state where the pressure in the auxiliary region 21 is lower than the water pressure of the outside W of the housing 11 when the piston 13 receives the water pressure of the outside W of the housing 11 from the second pressure receiving chamber 18 side and moves from the rod-retreated position to the rod-expanded position. This allows the piston 13 to move from the rod-retreated position to the rod-expanded position assuredly. The auxiliary region 21 serves to keep temperature increase in the first pressure receiving chamber 17, the temperature increase occurring due to adiabatic compression when the piston 13 moves from the rod-retreated position to the rod-expanded position, to be within an allowable range (e.g., within the operating temperature limit of, for example, the housing 11, the piston 13, or the rod 14). In the present embodiment, the auxiliary region 21 is disposed such that the auxiliary region 21 and the movement region in which the piston 13 moves in the up-down direction are arranged side by side in the horizontal direction. However, as an alternative, the auxiliary region 21 may be disposed below the movement region of the piston 13.

The release chamber 31 is formed in the housing 11. The internal pressure of the release chamber 31 is kept lower than the water pressure of the outside W of the housing 11. When the underwater actuator 1A is in the initial state, a compressible fluid (e.g., air) is encapsulated in the release chamber 31, and the internal pressure of the release chamber 31 is, for example, kept to the atmospheric pressure. The volume of the release chamber 31 is a sufficient volume for keeping, while the piston 13 moves from the rod-expanded position to the rod-retreated position, a state where force that is exerted on the piston 13 from the first pressure receiving chamber 17 side directly or via the rod 14 is greater than force that is exerted on the piston 13 from the second pressure receiving chamber 18 side, by releasing water from the second pressure receiving chamber 18 to the release chamber 31 as described below.

A first passage F1, through which water is led from the outside W of the housing 11 to the second pressure receiving chamber 18, a second passage F2, through which water is released from the second pressure receiving chamber 18 to the release chamber 31, and a third passage F3, through which the outside W of the housing 11 and the release chamber 31 communicate with each other, are formed in the housing 11. The first passage F1 is a passage extending from the first opening 11*a* to the second pressure receiving chamber 18. The second passage F2 is a passage extending from the second pressure receiving chamber 18 to the release chamber 31. The third passage F3 is a passage extending from the second opening 11*b* to the release chamber 31.

The first passage F1 and the second passage F2 include a shared passage 22, which is shared at the second pressure receiving chamber 18 side and which extends from an inlet/outlet port 23 of the second pressure receiving chamber 18. The inlet/outlet port 23, which is positioned at an end of the shared passage 22 at the second pressure receiving chamber 18 side, is provided with a restricting mechanism 25 for restricting the flow velocity of water flowing into the second pressure receiving chamber 18 or flowing out of the second pressure receiving chamber 18. It should be noted that the restricting mechanism 25 may be provided at any position of the shared passage 22. The second passage F2 and the third passage F3 include a shared passage 33, which is shared at the release chamber 31 side and which extends from an inlet/outlet port 32 of the release chamber 31.

A switching mechanism configured to switch communication states, i.e., allow or block communication, between three spaces that are the outside W of the housing 11, the second pressure receiving chamber 18, and the release chamber 31 is provided in the housing 11. The switching mechanism includes: a first switcher configured to switch the communication state between the second pressure receiving chamber 18 and the outside W of the housing 11 to allow or block communication therebetween; a second switcher configured to switch the communication state between the second pressure receiving chamber 18 and the release chamber 31 to allow or block communication therebetween; and a third switcher configured to switch the communication state between the release chamber 31 and the outside W of the housing 11 to allow or block communication therebetween. Hereinafter, the switching mechanism of the present embodiment is described in detail.

A sliding chamber 41 connected to the second pressure receiving chamber 18 via the shared passage 22 is formed in the housing 11. The switching mechanism of the present embodiment is a single spool 42 configured to move in a sliding manner in the sliding chamber 41. An electric actuator 51 serving as a drive device is disposed over the spool 42.

The sliding chamber 41 has a cylindrical inner peripheral surface extending downward from the second opening 11*b* formed in the upper surface of the housing 11. The sliding chamber 41 is formed such that the sliding chamber 41 is, at its lower end, connected to the aforementioned first opening 11*a*. Also, the sliding chamber 41 is, above the connecting point to the first opening 11*a*, connected to the shared passage 22, which extends from the inlet/outlet port 23 of the second pressure receiving chamber 18. Further, the sliding chamber 41 is, above the connecting point to the shared passage 22, connected to the shared passage 33, which extends from the inlet/outlet port 32 of the release chamber 31.

The spool 42 is inserted in the sliding chamber 41 from the second opening 11*b*, and is moved downward by the electric actuator 51. The spool 42 includes a first land 43*a*, a second land 43*b*, a third land 43*c*, which are arranged upward in this order, and a shaft 44 coupling these lands. That is, the first land 43*a*, the second land 43*b*, and the third land 43*c* are arranged in this order from the front end toward the rear end of the spool 42 in its moving direction. Each of the first land 43*a*, the second land 43*b*, and the third land 43*c* includes an outer peripheral surface that contacts with the inner peripheral surface of the sliding chamber 41. The shaft 44, at its upper end portion 44*a*, contacts with a lower end portion 52*a* of a drive shaft 52 of the electric actuator 51.

The electric actuator 51 is installed in the underwater vehicle 2, and is disposed over the second opening 11*b*. The electric actuator 51 causes the drive shaft 52 to move in the up-down direction to control the position of the drive shaft 52. The spool 42, which is contacted by the drive shaft 52, is pushed downward by the drive shaft 52 along the sliding chamber 41. It should be noted that it is not necessary that the drive shaft 52 and the spool 42 be in a non-coupled state. As one example, the drive shaft 52 and the spool 42 may be coupled together, such that the spool 42 moves also upward along the sliding chamber 41 in accordance with the movement of the drive shaft 52.

In the present embodiment, the spool 42 moves in a direction from the upper end to the lower end of the sliding chamber 41, such that the position of the spool 42 shifts from a first position to a second position, a third position, and a fourth position in this order. The spool 42, in accordance with its position moved by the electric actuator 51, switches the communication states, i.e., allow or block communication, between the three spaces that are the outside W of the housing 11, the second pressure receiving chamber 18, and the release chamber 31.

When the spool 42 is in the first position, the first switcher blocks the second pressure receiving chamber 18 from the outside W of the housing 11, the second switcher blocks the second pressure receiving chamber 18 from the release chamber 31, and the third switcher blocks the release chamber 31 from the outside W of the housing 11. When the spool 42 moves from the first position to the second position, the first switcher allows the second pressure receiving chamber 18 to communicate with the outside W of the housing 11, the second switcher keeps blocking the second pressure receiving chamber 18 from the release chamber 31, and the third switcher keeps blocking the release chamber 31 from the outside W of the housing 11. When the spool 42 moves from the second position to the third position, the first switcher blocks the second pressure receiving chamber 18 from the outside W of the housing 11, the second switcher allows the second pressure receiving chamber 18 to communicate with the release chamber 31, and the third switcher keeps blocking the release chamber 31 from the outside W of the housing 11. When the spool 42 moves from the third position to the fourth position, the first switcher keeps blocking the second pressure receiving chamber 18 from the outside W of the housing 11, the second switcher blocks the second pressure receiving chamber 18 from the release chamber 31, and the third switcher allows the release chamber 31 to communicate with the outside W of the housing 11.

In the present embodiment, each of the first land 43*a*, the second land 43*b*, and the third land 43*c* of the spool 42 functions as the first switcher, the second switcher, or the third switcher in accordance with the position of the spool 42.

When the underwater actuator 1A is in the initial state before the rod 14 is driven, the spool 42 is in the first position. As shown in FIG. 1, when the spool 42 is in the first position, no two of the three spaces communicate with each other, i.e., the three spaces are completely blocked from each other. More specifically, the first land 43*a* blocks the communication between the outside W of the housing 11 and the second pressure receiving chamber 18. The second land 43*b* blocks the communication between the second pressure receiving chamber 18 and the release chamber 31. The third land 43*c* blocks the communication between the release chamber 31 and the outside W of the housing 11.

As shown in FIG. 2, when the spool 42 is in the second position, the communication states between the three spaces are such that the second pressure receiving chamber 18 and the outside W of the housing 11 communicate with each other, but the other communication is blocked. More specifically, the first land 43*a* is disposed such that both the second pressure receiving chamber 18 and the outside W of the housing 11 communicate with the space between the first land 43*a* and the second land 43*b* in the sliding chamber 41. The second land 43*b* blocks the communication between the second pressure receiving chamber 18 and the release chamber 31. The third land 43*c* blocks the communication between the release chamber 31 and the outside W of the housing 11.

As shown in FIG. 3, when the spool 42 is in the third position, the communication states between the three spaces are such that the second pressure receiving chamber 18 and the release chamber 31 communicate with each other, but the other communication is blocked. More specifically, the second land 43*b* is disposed such that both the second pressure receiving chamber 18 and the release chamber 31 communicate with the space between the second land 43*b* and the third land 43*c* in the sliding chamber 41. The second land 43*b* blocks the communication between the second pressure receiving chamber 18 and the outside W of the housing 11. The third land 43*c* blocks the communication between the release chamber 31 and the outside W of the housing 11.

As shown in FIG. 4, when the spool 42 is in the fourth position, the communication states between the three spaces are such that the release chamber 31 and the outside W of the housing 11 communicate with each other, but the other communication is blocked. More specifically, the third land 43*c* is disposed such that the release chamber 31 communicates with the space between the third land 43*c* and the second opening 11*b* in the sliding chamber 41. The second land 43*b* blocks the communication between the second pressure receiving chamber 18 and the outside W of the housing 11. The third land 43*c* blocks the communication between the release chamber 31 and the second pressure receiving chamber 18.

Next, bi-directional driving of the rod 14 in the underwater actuator 1A is described in accordance with the sequence of switching operations performed by the switching mechanism.

Before the underwater vehicle 2 submerges under water, the underwater actuator 1A mounted to the underwater vehicle 2 is in the initial state, and as shown in FIG. 1, the spool 42 is disposed such that it is in the first position in a state where the rod 14 is retreated in the housing 11, i.e., in a state where the piston 13 is in the rod-retreated position. While the underwater vehicle 2 is under water, the water pressure of the outside W of the housing 11 is exerted on the rod distal end portion 14*b* of the underwater actuator 1A.

As shown in FIG. 2, in order to drive the rod 14 from the rod-retreated position to the rod-expanded position, the electric actuator 51 moves the spool 42 downward from the first position to the second position. As a result of the spool 42 being disposed in the second position, the second pressure receiving chamber 18 is brought into communication with the outside W of the housing 11, and thereby the water of the outside W of the housing 11 is supplied to the second pressure receiving chamber 18 through the first opening 11*a*. In this manner, force that is exerted on the piston 13 from the second pressure receiving chamber 18 side can be made greater than force that is exerted on the piston 13 from the first pressure receiving chamber 17 side directly or via the rod 14, and thereby the rod 14 can be driven to the first pressure receiving chamber 17 side.

As shown in FIG. 3, in order to drive the rod 14 from the rod-expanded position to the rod-retreated position, the electric actuator 51 moves the spool 42 further downward from the second position to the third position. As a result of the spool 42 being disposed in the third position, the second pressure receiving chamber 18 is blocked from the outside W of the housing 11, but the second pressure receiving chamber 18 is brought into communication with the release chamber 31 to release the water in the second pressure receiving chamber 18 to the release chamber 31. In this manner, the internal pressure of the second pressure receiving chamber 18 is reduced, and force that is exerted on the piston 13 from the first pressure receiving chamber 17 side directly or via the rod 14 can be made greater than force that is exerted on the piston 13 from the second pressure receiving chamber 18 side, and thereby the rod 14 can be driven to the second pressure receiving chamber 18 side.

After the underwater vehicle 2 has finished its work and before the underwater vehicle 2 is caused to rise toward the water surface, as shown in FIG. 4, the electric actuator 51 moves the spool 42 further downward from the third position to the fourth position. As a result of the spool 42 being disposed in the fourth position, the second pressure receiving chamber 18 is blocked from the release chamber 31, and the release chamber 31 is brought into communication with the outside W of the housing 11 to adjust the internal pressure of the release chamber 31 to be the same as the pressure of the outside W of the housing 11. In this state, the underwater vehicle 2 rises toward the water surface. As the underwater actuator 1A moves closer to the water surface, the internal pressure of the release chamber 31 is reduced. As a result, on the ocean, the underwater actuator 1A can be removed and collected from the underwater vehicle 2 in a condition where the pressure in the release chamber 31 is reduced.

As described above, in the present embodiment, when the underwater actuator 1A is under water, by moving the spool 42 from the first position to the second position to bring the second pressure receiving chamber 18 into communication with the outside W of the housing 11, the water of the outside W of the housing 11 can be led to the second pressure receiving chamber 18. In this manner, the piston 13 can be moved to the first pressure receiving chamber 17 side by the water pressure led to the second pressure receiving chamber 18, and thereby the rod 14 can be expanded from the housing 11.

On the other hand, by moving the spool 42 from the second position to the third position to bring the second pressure receiving chamber 18 into communication with the release chamber 31, the water in the second pressure receiving chamber 18 can be released to the release chamber 31, and thereby the internal pressure of the second pressure receiving chamber 18 can be reduced. In this manner, the piston 13 can be moved to the second pressure receiving chamber 18 side by the water pressure exerted on the rod distal end portion 14*b*, and thereby the rod 14 can be retreated into the housing 11.

As described above, by switching the communication states, i.e., allowing or blocking the communication, between the second pressure receiving chamber 18 and the outside W of the housing 11 and between the second pressure receiving chamber 18 and the release chamber 31, the rod 14 can be driven bi-directionally.

Further, in the present embodiment, by moving the spool 42 from the third position to the fourth position to bring the release chamber 31 into communication with the outside W of the housing 11, the internal pressure of the release chamber 31 can be adjusted to be the same as the pressure of the outside W of the housing 11. As a result, on the ocean, the underwater actuator 1A can be removed and collected from the underwater vehicle 2 in a safe condition where the pressure in the release chamber 31 is reduced.

Still further, in the present embodiment, the first passage F1 and the second passage F2 include the shared passage 22 shared at the second pressure receiving chamber 18 side. This makes it possible to simplify the internal configuration of the housing 11.

Still further, in the present embodiment, the switching mechanism is the single spool 42, which has the functions of all the first, second, and third switchers. This makes it possible to realize a simple configuration of the switching mechanism with fewer components.

Still further, in the present embodiment, the bi-directional driving of the rod 14 and safe collection of the underwater actuator 1A can be realized with the configuration that moves the spool 42 in a single direction. Therefore, it is not necessary that the shaft 44 of the spool 42 and the drive shaft 52 of the electric actuator 51 be coupled together, and the underwater actuator 1A can be readily removed from the underwater vehicle 2. Moreover, since the electric actuator 51 is mounted in the underwater vehicle 2, the underwater actuator 1A can be made compact, and no electrical components are necessary in the underwater actuator 1A. This makes it possible to simplify the configuration of the underwater actuator 1A.

Since the underwater vehicle 2 includes the underwater actuator 1A, the underwater vehicle 2 can perform work that requires bi-directional driving under water. Moreover, since the underwater vehicle 2 includes the underwater actuator 1A in a removable manner, after the underwater actuator 1A has been used, it can be readily replaced with an unused one. Furthermore, since the housing 11 is configured to be dividable into the first casing 15, in which the cylinder chamber 12 is formed, and the second casing 16, in which the release chamber 31 is formed, only the second casing 16 can be replaced.

Still further, the underwater actuator 1A of the present embodiment is configured to drive the rod 14 by utilizing the water pressure. This makes it possible to reduce energy required for driving. Therefore, the present embodiment is useful particularly in cases, for example, where the above-described underwater vehicle 2 is an autonomous unmanned underwater vehicle that utilizes a built-in battery or the like as its energy source.

The above-described embodiment is in all aspects illustrative, and should be interpreted as not restrictive. The scope of the present invention is defined by the appended claims rather than by the description preceding them, and all changes that fall within metes and bounds of the claims, or equivalence of such metes and bounds thereof are therefore intended to be embraced by the claims.

For example, the moving direction of the piston relative to the underwater vehicle 2 need not be the up-down direction. Alternatively, for example, the underwater actuator 1A may be configured to move the rod 14 in the horizontal direction in a reciprocating manner. The arrangement and orientation of the cylinder chamber 12, the release chamber 31, and the switching mechanism in the housing 11, the shape of the housing 11, the arrangement of the first opening 11*a* and the second opening 11*b*, etc., are not limited to the above-described embodiment. Passages formed in the housing 11 are also not limited to the above-described configuration. For example, the first passage F1 and the second passage F2 need not include the shared passage. In the underwater actuator 1A, the switching mechanism need not include the third switcher. In the above-described embodiment, the fluid encapsulated in the first pressure receiving chamber 17 is a compressible fluid. However, for example, in a case where the cylinder chamber 12 is configured such that the volume of the auxiliary region 21 expands by an amount that corresponds to the movement of the piston 13 from the rod-retreated position to the rod-expanded position, the fluid encapsulated in the first pressure receiving chamber 17 may be a non-compressible fluid.

The internal pressure of each of the first pressure receiving chamber 17, the second pressure receiving chamber 18, and the release chamber 31 when the underwater actuator 1A is in the initial state need not be the atmospheric pressure, but may be, for example, set to a pressure that is suitable for driving the rod 14 bi-directionally in consideration of, for example, the cross-sectional area of the rod 14 and the water pressure of the outside W of the housing 11 when the rod 14 is driven.

In the above-described embodiment, the electric actuator 51 serving as a drive device is mounted in the underwater vehicle 2. However, as an alternative, the drive device may be provided in the underwater actuator 1A. The cushioning 27 and the cushioning 28 may be eliminated from the cylinder chamber 12, or the cylinder chamber 12 may be provided with either one of the cushioning 27 or the cushioning 28.

The cylinder chamber 12 may be configured without the auxiliary region 21. In this case, the piston 13 of the underwater actuator 1A in the initial state moves from the rod-retreated position to a position where force that is exerted on the piston 13 from the first pressure receiving chamber 17 side and force that is exerted on the piston 13 from the second pressure receiving chamber 18 side are in balance, thereby expanding the rod 14. It should be noted that in a case where the cylinder chamber 12 is configured to include the auxiliary region 21, the stroke range of the rod 14 can be set to a predetermined range.

In the above-described embodiment, the switching mechanism is the single spool 42, which has the functions of all the first, second, and third switchers. However, as an alternative, the switching mechanism may be configured such that the first switcher, the second switcher, and the third switcher are operated independently of each other. For example, the switching mechanism may be configured to include a spool corresponding to the first switcher and another spool corresponding to the second switcher.

Figure 5:
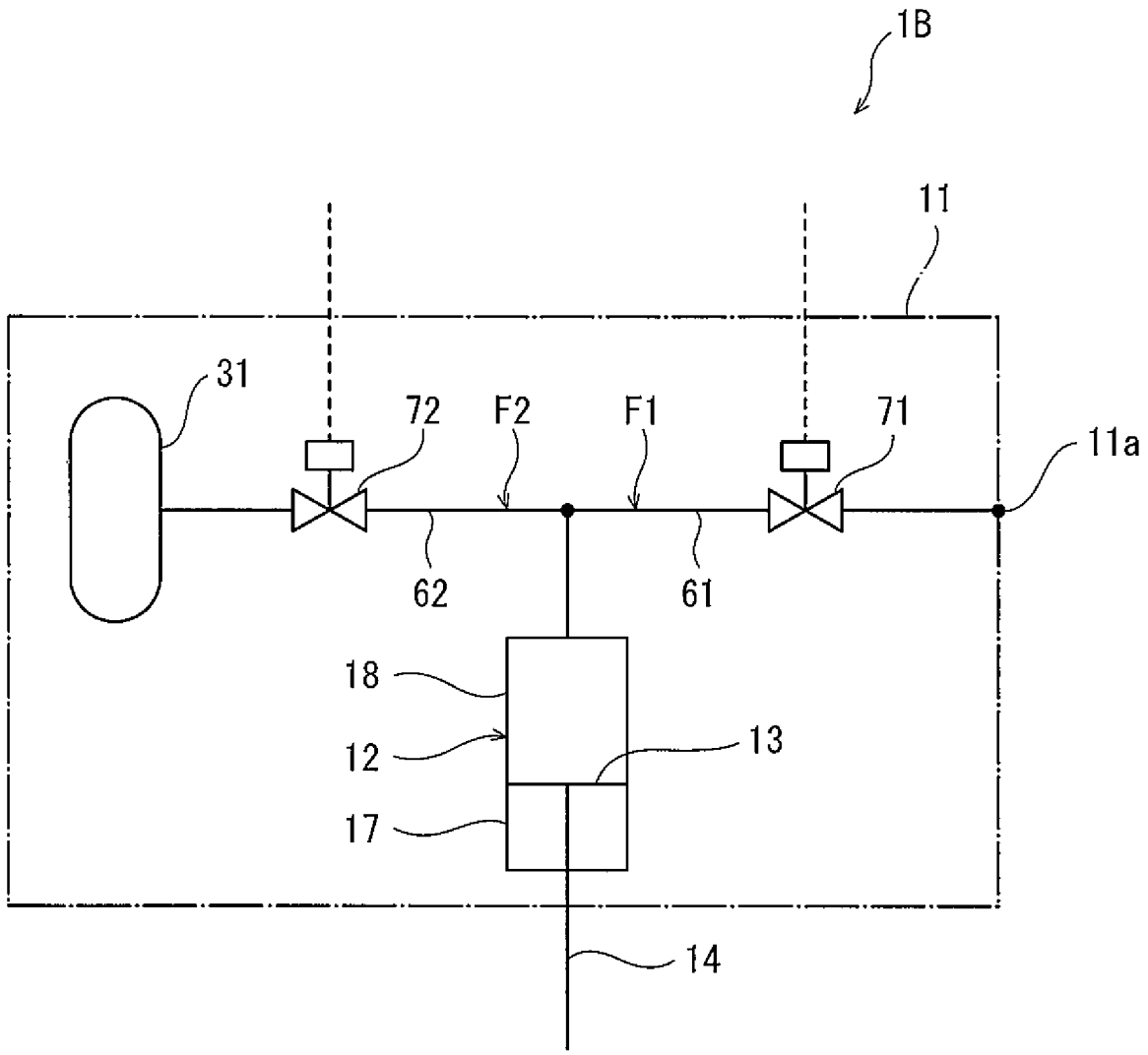
FIG. 5 is a schematic circuit diagram of an underwater actuator according to one variation.

The switching mechanism may be a mechanism different from a spool. As one example, FIG. 5 shows a schematic circuit diagram of an underwater actuator 1B according to one variation. In the underwater actuator 1B, a portion 61 of the first passage F1 excluding the shared passage 22 and a portion 62 of the second passage F2 excluding the shared passage 22 are provided with solenoid cutoff valves 71 and 72, respectively, which serve as the switching mechanism. The solenoid cutoff valve 71 of the first passage F1 functions as the first switcher, and the solenoid cutoff valve 72 of the second passage F2 functions as the second switcher. These solenoid cutoff valves 71 and 72 are each electrically connected to an unshown control device provided in the underwater vehicle 2. Each of the solenoid cutoff valves 71 and 72 opens/blocks a corresponding one of the passages F1 and F2 in accordance with a command current from the control device.

When the underwater actuator 1B is in the initial state, the solenoid cutoff valve 71 blocks the second pressure receiving chamber 18 from the outside W of the housing 11, and the solenoid cutoff valve 72 blocks the second pressure receiving chamber 18 from the release chamber 31.

Next, in order to drive the rod 14 from the rod-retreated position to the rod-expanded position, the solenoid cutoff valve 71 allows the second pressure receiving chamber 18 to communicate with the outside W of the housing 11, and the solenoid cutoff valve 72 keeps blocking the second pressure receiving chamber 18 from the release chamber 31.

Thereafter, in order to drive the rod 14 from the rod-expanded position to the rod-retreated position, the solenoid cutoff valve 71 blocks the second pressure receiving chamber 18 from the outside W of the housing 11, and the solenoid cutoff valve 72 allows the second pressure receiving chamber 18 to communicate with the release chamber 31.

As described above, similar to the underwater actuator 1A in which the spool serves as the switching mechanism, the underwater actuator 1B in which the solenoid cutoff valves serve as the switching mechanism is also capable of driving the rod 14 bi-directionally by performing the switching operations in the above-described manner.

In the underwater actuator 1B, the release chamber 31 may be provided with an on-off valve functioning as the third switcher, which switches the communication state between the release chamber 31 and the outside W of the housing 11 to allow or block communication therebetween. In this case, before causing the underwater actuator 1B to rise toward the water surface for the collection of the underwater actuator 1B, the pressure in the release chamber 31 can be reduced by performing the same switching operation as that performed by the switching mechanism of the underwater actuator 1A, and as a result, on the ocean, the underwater actuator 1B can be collected in a safe condition where the pressure in the release chamber 31 is reduced.

In a case where the release chamber 31 has a sufficient volume, the rod 14 coupled to the drive device may be driven in a reciprocating manner so that even after the piston 13 has moved from the rod-expanded position to the rod-retreated position, the rod 14 can be further driven in a reciprocating manner. The "sufficient volume" herein means, for example, a volume that is sufficient for keeping a state where force that is exerted on the piston 13 from the first pressure receiving chamber 17 side is greater than force that is exerted on the piston 13 from the second pressure receiving chamber 18 side even when water present in a region formed by the release chamber 31 and the second passage F2 is in an amount that is twice, or more, the amount of water present in the movement region 20 of the cylinder chamber 12. Further, in the above-described embodiment, the number of release chambers 31 formed in the housing 11 is one. However, as an alternative, a plurality of release chambers may be formed in the housing 11, and each time the rod is driven in a reciprocating manner, the release chamber to be used may be switched among the plurality of release chambers by taking turns. This configuration makes it possible to assuredly drive the rod in a reciprocating manner the same number of times as the number of release chambers.

REFERENCE SIGNS LIST

1A, 1B underwater actuator
2 underwater vehicle
11 housing
12 cylinder chamber
13 piston
14 rod
17 first pressure receiving chamber
18 second pressure receiving chamber
20 movement region
21 auxiliary region
22 shared passage
25 restricting mechanism
27, 28 cushioning
31 release chamber
41 sliding chamber
42 spool
43*a* first land
43*b* second land
43*c* third land
51 electric actuator
52 drive shaft
71, 72 solenoid cutoff valve
F1 first passage
F2 second passage

The invention claimed is:

1. An underwater actuator comprising:

a housing configured to be immersed under water;

a cylinder chamber formed in the housing;

a piston disposed in the cylinder chamber such that the piston is movable in a sliding manner in the cylinder chamber, the piston dividing the cylinder chamber into a first pressure receiving chamber and a second pressure receiving chamber;

a rod extending from the piston towards the first pressure receiving chamber, the rod penetrating the housing;

a release chamber formed in the housing, the release chamber having an internal pressure kept lower than a water pressure of an outside of the housing;

a first passage formed in the housing, the first passage transferring water from the outside of the housing to the second pressure receiving chamber;

a second passage formed in the housing, the second passage transferring water from the second pressure receiving chamber to the release chamber, wherein the first passage and the second passage include a shared passage shared at the second pressure receiving chamber;

a switching mechanism including:

a single spool;

a first switcher disposed in the first passage and configured to switch a communication state either to allow or to block a communication between the second pressure receiving chamber and the outside of the housing; and a second switcher disposed in the second passage and configured to switch a communication state either to allow or to block a communication between the second pressure receiving chamber and the release chamber; and a sliding chamber formed in the housing and connected to the second pressure receiving chamber via the shared passage, the single spool being configured to slide in the sliding chamber.

2. The underwater actuator according to claim 1, wherein the shared passage includes a restricting mechanism.

3. An underwater actuator comprising:

a housing configured to be immersed under water;

a cylinder chamber formed in the housing;

a piston disposed in the cylinder chamber such that the piston is movable in a sliding manner in the cylinder chamber, the piston dividing the cylinder chamber into a first pressure receiving chamber and a second pressure receiving chamber;

a rod extending from the piston towards the first pressure receiving chamber, the rod penetrating the housing;

a release chamber formed in the housing, the release chamber having an internal pressure kept lower than a water pressure of an outside of the housing;

a first passage formed in the housing, the first passage transferring water from the outside of the housing to the second pressure receiving chamber;

a second passage formed in the housing, the second passage transferring water from the second pressure receiving chamber to the release chamber, wherein the first passage and the second passage include a shared passage shared at the second pressure receiving chamber; and a switching mechanism including:

a single spool configured to slide in a sliding chamber;

a first switcher disposed in the first passage and configured to switch a communication state either to allow or to block a communication between the second pressure receiving chamber and the outside of the housing;

a second switcher disposed in the second passage and configured to switch a communication state either to allow or to block a communication between the second pressure receiving chamber and the release chamber; and a third switcher configured to switch a communication state either to allow or to block a communication between the release chamber and the outside of the housing.

4. The underwater actuator according to claim 1, wherein:

the spool is configured to move in the sliding chamber from a first end of the sliding chamber toward a second end of the sliding chamber such that a position of the spool shifts in a sequential order from a first position to a second position and to a third position, when the spool is in the first position, the first switcher blocks communication between the second pressure receiving chamber and the outside of the housing, and the second switcher blocks communication between the second pressure receiving chamber and the release chamber, when the spool moves from the first position to the second position, the first switcher allows communication between the second pressure receiving chamber and the outside of the housing, and the second switcher continues to block communication between the second pressure receiving chamber and the release chamber, and when the spool moves from the second position to the third position, the first switcher blocks communication between the second pressure receiving chamber and the outside of the housing, and the second switcher allows communication between the second pressure receiving chamber and the release chamber.

5. An underwater vehicle comprising:

the underwater actuator according to claim 4; and an electric actuator including a drive shaft configured to push the spool, wherein the spool is not coupled to the drive shaft.

6. The underwater actuator according to claim 1, wherein the switching mechanism further includes a third switcher configured to switch a communication state either to allow or to block a communication between the release chamber and the outside of the housing, the spool is configured to move in the sliding chamber from a first end of the sliding chamber toward a second end of the sliding chamber such that a position of the spool shifts in sequential order from a first position to a second position, to a third position, and to a fourth position, when the spool is in the first position, the first switcher blocks communication between the second pressure receiving chamber and the outside of the housing, the second switcher blocks communication between the second pressure receiving chamber and the release chamber, and the third switcher blocks communication between the release chamber and the outside of the housing, when the spool moves from the first position to the second position, the first switcher allows communication between the second pressure receiving chamber the outside of the housing, the second switcher continues to block communication between the second pressure receiving chamber and the release chamber, and the third switcher continues to block communication between the release chamber and the outside of the housing, when the spool moves from the second position to the third position, the first switcher blocks communication between the second pressure receiving chamber and the outside of the housing, the second switcher allows communication between the second pressure receiving chamber and the release chamber, and the third switcher continues to block communication between the release chamber and the outside of the housing, and when the spool moves from the third position to the fourth position, the first switcher continues to block communication between the second pressure receiving chamber and the outside of the housing, the second switcher blocks communication between the second pressure receiving chamber and the release chamber, and the third switcher allows communication between the release chamber and the outside of the housing.

7. The underwater actuator according to claim 1, wherein a compressible fluid is encapsulated in the first pressure receiving chamber, the cylinder chamber includes:

a movement region, in which the piston is configured to move between a rod-expanded position and a rod-retreated position, the movement region forming the second pressure receiving chamber and a part of the first pressure receiving chamber; and an auxiliary region, into which the compressible fluid of the movement region flows when the piston moves from the rod-retreated position to the rod-expanded position, the auxiliary region forming a remaining part of the first pressure receiving chamber, and a pressure in the auxiliary region is lower than the water pressure of the outside of the housing when the piston moves from the rod-retreated position to the rod-expanded position.

8. The underwater actuator according to claim 1, wherein the piston moves between a rod-expanded position and a rod-retreated position, and cushioning that contacts with the piston when the piston is in the rod-expanded position or cushioning that contacts with the piston when the piston is in the rod-retreated position is provided in the cylinder chamber.

9. An underwater vehicle comprising:

the underwater actuator according to claim 1; and a drive device configured to move the spool in the sliding manner.

* * * * *